United States Patent [19]

Spilman et al.

[11] Patent Number: 4,807,872

[45] Date of Patent: Feb. 28, 1989

[54] CHILD SWING WITH UPSTANDING MEMBERS IN ABUTTING RELATIONSHIP

[75] Inventors: Raymond Spilman, Darien; Jacob Krapowicz, Ridgefield, both of Conn.; Alvin Fowler, Columbus, Ind.

[73] Assignee: Cosco, Inc., Columbus, Ind.

[21] Appl. No.: 934,670

[22] Filed: Nov. 25, 1986

[51] Int. Cl.[4] ..... A63G 9/12

[52] U.S. Cl. ..... 272/86; 272/85; 297/277

[58] Field of Search ..... 297/277, 278, 281, 282, 297/440, 441; 272/85, 86

[56] References Cited

U.S. PATENT DOCUMENTS

| | | | |
|---|---|---|---|
| D. 264,148 | 5/1982 | Gebhard | D6/4 |
| 463,863 | 11/1891 | Johnson | 297/282 |
| 465,275 | 12/1891 | Kennedy et al. | 297/277 |
| 648,740 | 5/1900 | Haggard et al. | 297/277 |
| 1,231,686 | 7/1917 | Zuniga | 297/281 |
| 1,379,566 | 5/1921 | Holland | 297/440 |
| 1,544,187 | 6/1925 | Schroeder | 297/281 |
| 4,271,627 | 6/1981 | Echterling | 272/85 X |
| 4,323,233 | 4/1982 | Gebhard | 272/86 |
| 4,325,578 | 4/1982 | Borucki | 297/281 |
| 4,341,420 | 7/1982 | Knowles et al. | 272/281 X |

OTHER PUBLICATIONS

Bollinger and Cramer, "Baby Gear Guide", copyright 1985, p. 76.

*Primary Examiner*—Richard T. Stouffer
*Assistant Examiner*—Sam Rimell
*Attorney, Agent, or Firm*—Barnes & Thornburg

[57] ABSTRACT

A swing assembly for a small child is provided. The swing assembly includes first and second upright swing support frames, with each support frame being formed from a pair of upstanding support members. A base member is provided for rigidly fixing the pair of upstanding support members side-by-side one another in substantially perpendicular relation to an underlying surface. A swing seat is provided as well as hangers connected to the seat for suspending the swing seat in the swing-receiving space. The hangers are pivotally connected to the upper portions of the spaced-apart pairs of upstanding support members so that the hangers and the swing seat pivot about an axis that extends between the pairs of upstanding support members during movement of the swing seat relative to the first and second swing support frames.

13 Claims, 3 Drawing Sheets

CHILD SWING WITH UPSTANDING MEMBERS IN ABUTTING RELATIONSHIP

BACKGROUND AND SUMMARY OF THE INVENTION

The present invention relates to swings for children More particularly, the present invention relates to an indoor swing for small children in which the swing seat is suspended between two spaced apart support frames with no overlying structure.

Conventional swings for small children generally include an overhead or overlying structure to which the swing seat is attached for pivotal movement. Generally the overhead structure is supported by two rear legs that extend downwardly from the overhead structure and two forward legs that also extend downwardly from the overhead structure in a splayed relation. The overhead structure of such known child swings restricts the access to the seat, and also generally requires that the entire swing structure be taller than absolutely necessary. One such swing is disclosed in U.S. Pat. No. 4,323,233. U.S. Pat. No. 4,323,233 discloses an infant swing that includes a seat that is pivotally connected to an overhead frame. Two rear legs extend downwardly from the overhead frame, as well as two front legs. The rear legs are foldable into a parallel relation to the front legs for transportation and storage of the swing.

One problem with the known swings as illustrated in U.S. Pat. No. 4,323,233, is that the swings are not easily disassembled for storage or shipping. Another problem with the known swings is that the overhead frame member restricts access to the swing seat.

One object of the present invention is to Provide a child swing that does not require an overhead support structure to support the swing seat.

Another object of the present invention is to provide a child swing in which the frame is easy to assemble and disassemble to permit easy storage and shipment of the swing.

Yet another object of the present invention is to provide a child swing in which the frame is easy to manufacture, and specifically a child swing that utilizes a number of components that are interchangeable with each other.

Yet another object of the present invention is to provide a child swing in which at least the frame portion of the swing is constructed from components that have somewhat complementary sizes so that they can be easily positioned into a minimal space for shipping and storage.

Yet another object of the present invention is to provide a child swing in which the frame provides a stable rigid support for the swing, and at the s-same time presents an attractive and attention-getting appearance to younger children.

According to the present invention, a swing assembly is provided that includes, first and second upright swing support frames, wherein each support frame is formed from a pair of upstanding support members. Base means are provided for rigidly fixing the pair of upstanding support members side-by-side to abut one another in substantially perpendicular relation to an underlying surface. First coupling means are provided for interconnecting horizontal portions of the base means and second coupling means are provided for coupling a vertical portion of the base means to the first and second swing support align the pairs of upstanding support members in spaced-apart parallel relation to define a swing-receiving space between the support frames. Each pair of upstanding support members cooperate to provide distal portions that are situated vertically and spaced-apart from the first coupling means. A swing seat is provided as well as plural two arm hanger means connected to the swing seat for suspending the swing seat in the swing-receiving space above the first coupling means. The hanger means are pivotally connected to each of the distal portions of the spaced-apart pairs of upstanding support members so that the hanger means and the swing seat pivot about an axis extending between the pairs of upstanding support members during movement of the swing seat relative to the first and second swing support frames.

One feature of the foregoing structure is that each pair of upstanding support members forming a swing support frame cooperate to provide distal portions that are situated vertically and spaced-apart from the first coupling means, with the hanger means being pivotally connected to each of the distal portions of the spaced-apart pairs of upstanding support members. One advantage of this feature is that the swing seat is supported by these spaced-apart pairs of upstanding support members for pivotal movement which eliminates the necessity of any overlying structure to support the swing seat.

In preferred embodiments of the present invention, the hanger means includes first and second hanger assemblies, with each hanger assembly including a seat arm fixed to the swing seat and a support arm pivotally connected to the selected swing support frame. Quick release means are provided for detachably interconnecting the seat arm and the corresponding support arm to permit selective separation of the swing seat from the first and second swing support frames. One advantage of this feature is that the swing seat is easily removed from the frame assembly for storage or shipping, and is likewise easily attached to the frame assembly for use following shipping or storage.

Also in preferred embodiments of the present invention, each base means includes an L-shaped member having a vertical leg that is connected to both companion upstanding support members to align the pair of upstanding support members in side-by-side relation. Locking means are also provided for rigidly retaining the vertical leg of the L-shaped member and its companion pair of upstanding support members in aligned relation to prevent relative movement of the support members that form each swing support frame. One advantage of this feature is that each swing support frame is formed from two companion upstanding support members, with the companion upstanding support members buttressed by an L-shaped member to add stability to the assembled frame.

Also in preferred embodiments of the present invention, the vertical leg of each L-shaped member includes a top portion that is formed to include a flange-receiving slot that opens toward the companion pair of upstanding support members, with each adjacent upstanding support member having a flange for engaging a selected portion of the flange-receiving slot to align the vertical leg and the companion pair of upstanding support members. One advantage of this feature is that the upstanding leg of each L-shaped member and the two companion upstanding support members cooperate to secure the components in a predetermined relative position so that the locking means is easily coupled to the vertical leg and the companion pair of upstanding support members to assemble the swing assembly.

Also in preferred embodiments of the present invention, the locking means includes a locking strip having a plurality of connectors that are configured to pass through apertures formed in the pair of upstanding support members and in the vertical leg to lockably engage the vertical leg to the pair of upstanding support members. One advantage of this feature is that the vertical leg of each L-shaped member may be securely and rigidly attached to the companion pair of upstanding support members to form a portion of the swing assembly that will provide a stable platform for the swing.

The swing assembly of the present invention thus provides the ability to easily assemble and disassemble the frame assembly for storage or shipping. The swing assembly of the present invention provides a frame to which the swing seat is pivotally attached that does not require any overlying structure to support the swing seat. This permits easy access to the swing seat, and also permits the frame assembly to be configured to provide a stable support for the swing seat.

Additional objects, features, and advantages of the invention will be apparent to those skilled in the art upon consideration of the following detailed description of a preferred embodiment exemplifying the best mode of carrying out the invention as presently Perceived.

BRIEF DESCRIPTION OF THE DRAWINGS

The detailed description particularly refers to the accompanying figures in which.

DETAILED DESCRIPTION OF THE DRAWINGS

Figure 1:
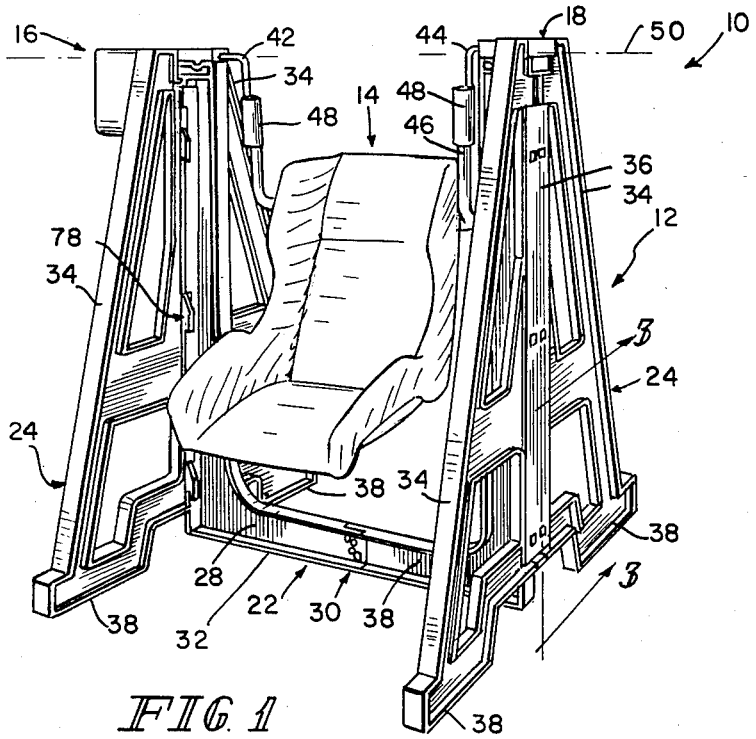
FIG. 1 is a perspective view of the present invention showing the swing assembly in an assembled configuration.

Referring now to FIG. 1, FIG. 1 shows a swing assembly 10 according to the present invention. The swing assembly 10 generally includes a frame assembly 12 having hanger means 42, 44, 46, AND 48 (to be described later) for supporting a seat shell 14. The hanger means are connected to a drive unit 16 and a support insert 18 that are configured to permit pivotal movement of the seat shell 14 about an axis 50 within the frame assembly 12. The frame assembly 12 includes two spaced apart A-shaped support frames 24 that are positioned in a spaced apart, parallel relationship with each other. A U-shaped base member 22 is interposed between the two upright A-shaped support frames 24, with the U-shaped base member 22 being substantially perpendicular to both of the A-shaped support frames 24. When assembled, the U-shaped base member 22 and the A-shaped support frames 24 cooperate to define a swing-receiving space between the two A-shaped support frames 24 that is not obstructed by any overlying structure. The swing, or seat shell 14 is supported laterally by the cooperating U-shaped base member 22 and the A-shaped support frames 24. Supporting the seat shell 14 from opposing sides permits unobstructed access to the seat shell 14 by eliminating any overlying structure that would otherwise be necessary to support the swing.

The U-shaped base member 22 is assembled from two L-shaped members 28. The two L-shaped members 28 are joined at a coupling joint 30 to form the U-shaped base member 22. It will be understood that forming the U-shaped base member 22 from two L-shaped members 28 permits disassembly of the swing assembly 10 into smaller, easier to store components. When assembled, the U-shaped base member 22 includes a bottom surface 32 that forms a portion of the base means for the frame assembly 12 Illustratively, the L-shaped members 28 are molded from a polymeric material and are identical to each other.

Each of the A-shaped support frames 24 is formed from two one-half A-shaped outrigger members 34. Illustratively, all four of the outrigger members 34 are identically shaped and sized to permit interchangeability of the outrigger members 34 to form the two A-shaped support frames 24. This interchangeability of the outrigger members 34 greatly increases the ease of manufacture and assembly of the swing assembly 10. Illustratively, the outrigger members 34 are molded from a polymeric material for ease of construction. The outrigger members 34, as well as the L-shaped members 28, may be colored to enhance the overall appearance and appeal to a child. Each of the outrigger members 34 includes a foot 38 that, when the members 34 are assembled to form an A-shaped support frame 24, cooperates with the U-shaped base member 22 to provide stability to the frame assembly 12.

A locking panel 36 is provided to lock two of the outrigger members 34 in a confronting relationship to form one A-shaped support frame 24. In addition, the locking panel 36 functions to secure the assembled A-shaped support frame 24 to one of the upright portions of the U-shaped base member 22 to form one-half of the frame assembly 12. It will be understood that two locking panels 36 are provided, with one locking panel 36 used for each half of the frame assembly 12. The use of a locking panel 36 will be discussed in greater detail in the discussion related to FIG. 2.

As can be seen in FIG. 1, the assembled frame assembly 12 provides a large and stable area of support for the seat shell 14 by the cooperation of the bottom surface 32 of the U-shaped base member 22 and the four feet 38 on the outrigger members 34. The upright portions of the U-shaped base member 22 function as buttresses to the assembled A-shaped support frames 24 to add stability to the frame assembly 12. The locking panels 36 securely engage the A-shaped support frames 24 to the U-shaped base member 22 to aid in stabilizing the frame assembly 12. In addition, the drive unit 16 and support insert 18 are configured to further lock each A-shaped support frame 24 to the U-shaped base member 22 to add stability. The locking function of the drive unit 16 and support insert 18 will be discussed further in the discussion related to FIGS. 4 and 5.

Two support arms 42, 44 are provided to support the seat shell 14 in the frame assembly 12. The support arm 42 is a driven support arm that is connected to the drive unit 16 to provide a driving or swinging force to the seat shell 14. The support arm 44 is undriven, and is connected to the support insert 18 that is mounted opposite the drive unit 16. Seat arms 46 are formed as part of the seat shell 14 and are connected to the support arms 42, 44 by couplings 48. The couplings 48 permit the seat shell 14 to be easily removed from the frame assembly 12 to disassemble the swing assembly 10 when desired. The support arms 42, 44, as well as the seat arms 46 and couplings 48 are located in a space defined between each upright portion of the U-shaped base member 22 and the corresponding edge of the seat shell 14. These spaces between each upright portion of the U-shaped base member 22 and the corresponding edge of the seat shell 14 define support regions for supporting the seat shell 14. The drive unit 16 and support insert 18, as well as the support arms 42, 44 cooperate to define a pivot axis 50 about which the seat shell 14 is permitted to pivot when the swing assembly 10 is assembled as shown in FIG. 1.

Figure 2:
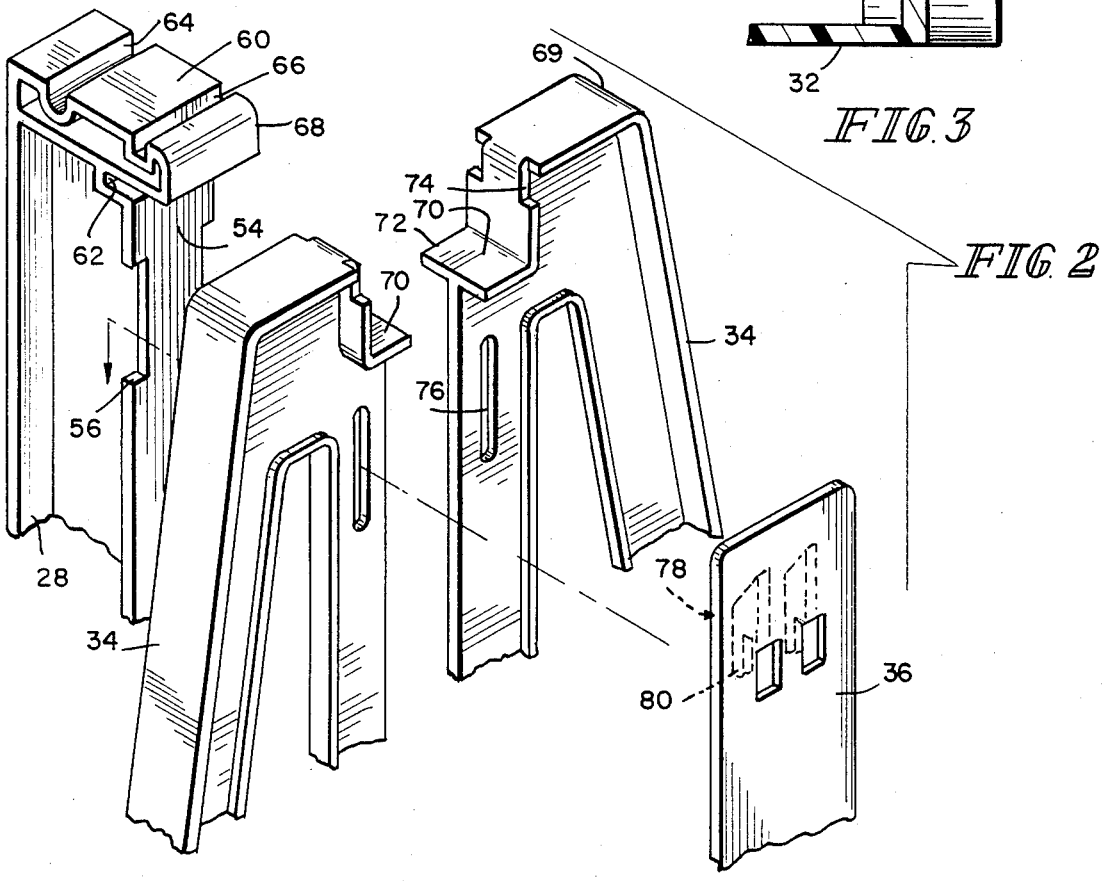
FIG. 2 is an exploded perspective view of a portion of one of the support frames.

FIG. 2 shows in greater detail the assembly of two of the outrigger members 34 together to form an A-shaped support frame 24 (FIG. 2), and the method of locking the assembled A-shaped support frame 24 to a portion of the U-shaped base member 22. Specifically, FIG. 2 shows one of the L-shaped members 28 that includes an outer face 54 that extends along the length of the L-shaped member 28. The face 54 includes opposing notches 56 that are formed on opposite edges of the face 54. Although not shown in FIG. 2, the face 54 on each L-shaped member 28 is formed to include three pair of notches 56 that are spaced apart in vertical alignment on the vertical portion of the L-shaped member 28. The upper end of the vertical leg of the L-shaped member 28 includes an upper support portion 60. A transverse, outwardly facing channel 62 is formed below the support portion 60 at the upper edge of the outer face 54. A cylindrical-shaped notch 64 is formed in the upper surface of the support portion 60 in spaced apart, parallel relation to a rectangular-shaped notch 66 that is also formed in the upper surface of the support portion 60. The notches 64, 66 are configured to receive either the drive unit 16 or support insert 18, as will be described in more detail in the discussion relating to FIGS. 4 and 5. A ledge 68 is formed at the extreme outer portion of the support portion 60 above the outer face 54 and channel 62.

Each outrigger member 34 includes an outer flange 69 that extends along its outer periphery. The flange 69 terminates at the corner of the outrigger member 34 in an L-shaped seat 70. The horizontal portion of the flange 69 in the L-shaped seat 70 forms a shoulder 72 that is sized and configured to be received in the channel 62 in the L-shaped member 28. A vertical notch 74 is formed in the flange 69 where the flange 69 turns downwardly to form the L-shaped seat 70. A vertical, elongated slot 76 is formed in the body of the outrigger member 34 below the L-shaped seat 70. Although not illustrated in FIG. 2, each outrigger member 34 includes three slots 76 that are spaced apart in vertical alignment on each outrigger member 34. The slots 76 are located on the outrigger members 34 to align with the notches 56 in the vertical portion of each L-shaped member 28. It will be understood that each of the outrigger members 34 is formed identically.

To assemble the two outrigger members 34 to the vertical leg of the L-shaped member 28 as illustrated in FIG. 2, the two outrigger members 34 are first brought together in a confronting relationship so that the two L-shaped seats 70 are abutting and confronting each other. The L-shaped member 28 is then moved toward the mated outrigger members 34 so that the shoulders 72 on each of the outrigger members 34 extend into the channel 62 in the L-shaped member 28. When properly assembled, the shoulders 72 will fit snugly within the channel 62, and the ledge 68 will seat in the L-shaped seats 70 to somewhat secure the outrigger members 34 to the L-shaped member 28. In this position, each of the slots 76 in the outrigger members 34 will be aligned with a corresponding notch 56 in the L-shaped member 28.

The slots 76 and corresponding notches 56 are shaped and configured to receive connectors 78 that are mounted on one side of the locking panels 36. Each of the connectors 78 includes a downwardly extending finger 80. The connectors 78 and fingers 80 are inserted through the slots 76 and adjacent notches 56 until the panel 36 is flush with the outer surfaces of the abutted outrigger members 34. The locking panel 36 is then slid downwardly so that each finger 80 engages the rear surface of the face 54 below the notch 56 to secure the abutted outrigger members 34 to the L-shaped member 28. It will be understood that there are two locking panels 36, and that each locking panel 36 includes three pair of connectors 78 to engage the three pair of slots 76 that are present in each assembled A-shaped support frame 24. It will also be understood that each half of the frame assembly 12 is assembled in an identical manner to that illustrated in FIG. 2.

Figure 3:
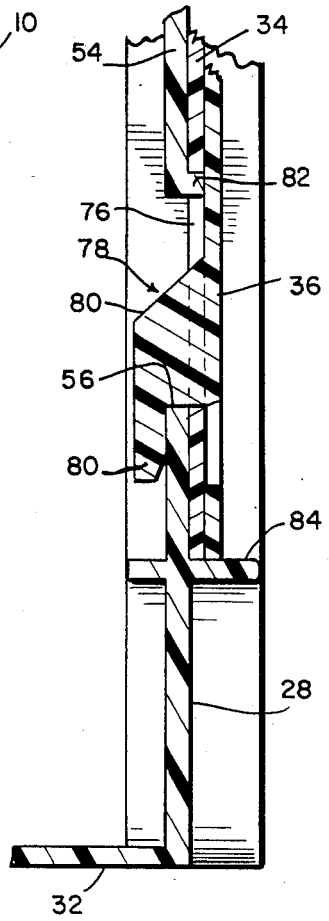
FIG. 3 is a cross-sectional view taken along lines 3—3 of FIG. 1 showing a locking panel in engagement with a notch and slot.
Figures 4, 5, 6:
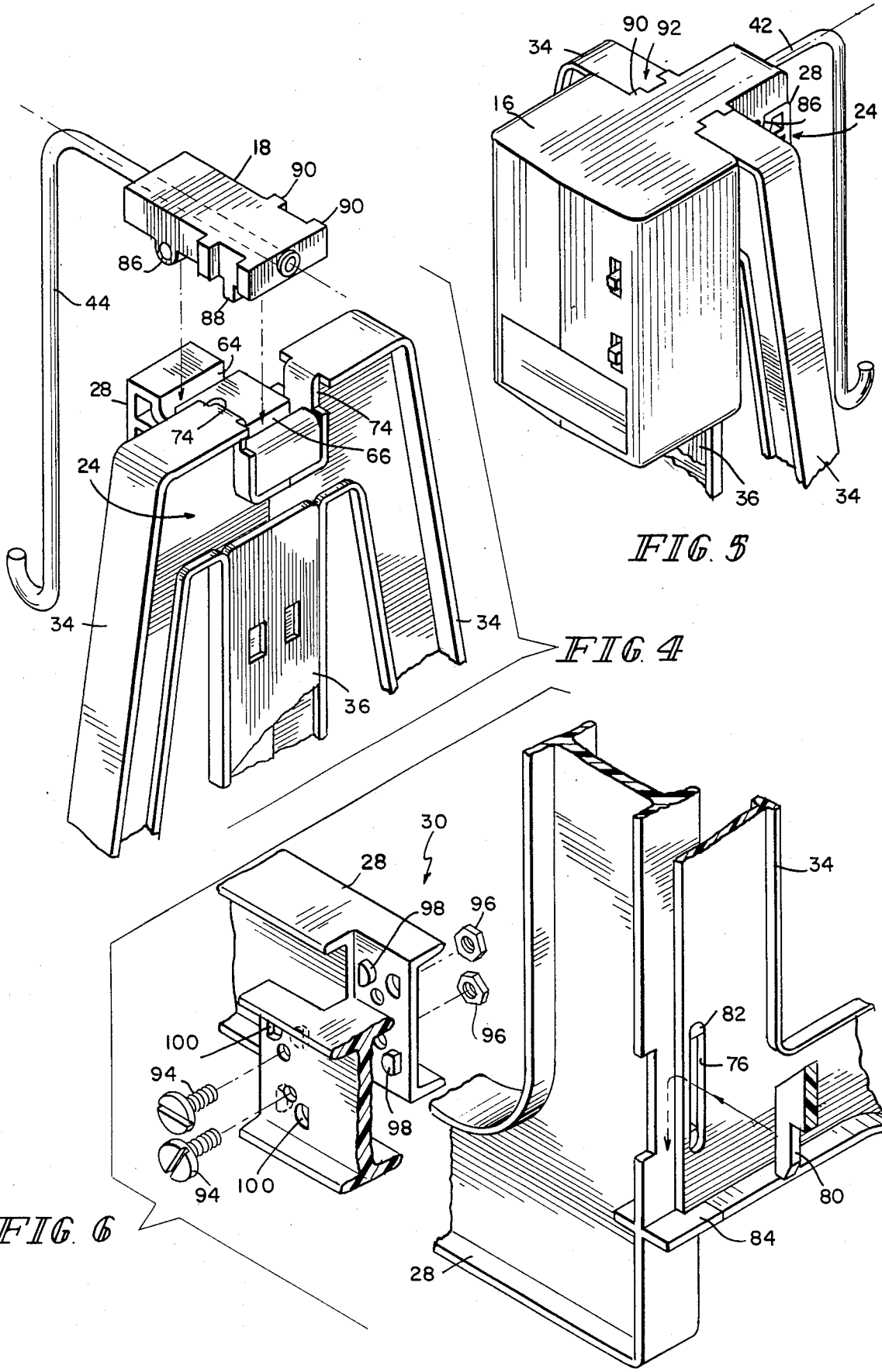
FIG. 4 is a perspective view of the assembled support frame shown in FIG. 2 with the addition of the support insert.
FIG. 5 is a perspective view of a portion of the opposite support frame showing the drive unit in position.
FIG. 6 is an exploded perspective view with portions broken away of the lower portion of the U-shaped base member showing the coupling joint.

FIG. 3 shows in greater detail the engagement of the connector 78 and fingers 80 with the slots 76 and notches 56. Specifically, FIG. 3 shows one of the connectors 80 on one of the locking panels 36 extending through one slot 76 and engaging one of the notches 56 to secure one of the outrigger members 34 to one side of the L-shaped member 28. Illustratively, FIG. 3 shows a slot 76 and corresponding notch 56 in the lower portion of an outrigger 34 and L-shaped member 28. To assist in aligning the slots 76 with the notches 56, each L-shaped member 28 includes a lower ledge 84 upon which the inner edge of each of the corresponding outrigger members 34 rests when properly positioned. By permitting the edges of the outrigger members 34 to rest upon this ledge 84, alignment of the slots 76 and corresponding notches 56 is made considerably easier. FIG. 6 provides a better illustration of the orientation of the ledge 84 and its relation to the outrigger members 34. The lower pair of slots 56 in each L-shaped member 28 include outwardly extending knobs 82 that are sized and configured to extend into the upper portion of the corresponding lower slots 76 in the outrigger members 34 to further aid in aligning the slots 76 with corresponding notches 56.

FIG. 4 shows the upper, or distal portion of one A-shaped support frame 24 and L-shaped member 28. Specifically, FIG. 4 shows the assembled upper portion of the A-shaped support frame 24 and L-shaped member 28 that is configured to receive the support insert 18. The support insert 18 is a somewhat rectangular-shaped structure that includes a cylindrical-shaped projection 86 that extends downwardly from its lower surface. A rectangular-shaped projection 88 also extends downwardly from the lower surface of the insert 18 in a parallel, spaced apart relationship with the projection 86. The projections 86, 88 are sized and configured to be snugly received within the complementary notches 64, 66, respectively in the support portion 60. In addition, a pair of outwardly extending, spaced apart ribs 90 are formed on each side of the insert 18. The ribs 90 are sized and configured to be received snugly within the notches 74 on each of the confronting outrigger members 34. When the support insert 18 is fitted into the upper portion of the assembled A-shaped support frame 24 and L-shaped member 28, the support insert 18 functions not only to support one-half of the seat shell 14, but also serves to lock the assembled A-shaped support frame 24 to the L-shaped member 28 to provide rigidity to the assembled frame assembly 12.

FIG. 5 shows the opposite side of the assembled frame assembly 12, and specifically the upper portion of the assembled A-shaped support frame 24 and L-shaped member 28 opposite that shown in FIG. 4 that is configured to receive the drive unit 16. The drive unit 16 includes projections 86, 88 identical to those illustrated on the support insert 18 shown in FIG. 4. In addition, the drive unit 16 includes identical ribs 90 that are sized and configured to be received into the notches 74 in the assembled, confronting outrigger members 34. Thus, the drive unit 16, when inserted into the assembled outrigger members 34 and L-shaped member 28, serves not only to provide a driving or swinging force to the seat shell 14, but also serves to add rigidity to the assembled frame assembly 12. It will be understood that because the configuration of the support insert 18 and the drive unit 16 are structurally identical, the drive unit 16 and support insert 18 are interchangeable with respect to opposite sides of the frame assembly 12. This increases the simplicity of the swing assembly 10 somewhat by allowing some flexibility in its assembly.

Although not shown in detail, the drive unit 16 is illustratively a battery powered drive unit that provides a swinging force to the driven support arm 42, and thus to the seat shell 14. This driving force to the seat shell 14 enables the seat shell 14 to maintain a pivoting motion about the axis 50 (FIG. 1).

FIG. 6 shows in greater detail the coupling joint 30 that joins the two L-shaped members 28 to form the U-shaped base member 22. FIG. 6 also shows in somewhat greater detail the lower portion of one of the L-shaped members 28 including the ledge 84 and its relationship to the outrigger member 34. The coupling joint 30 is illustratively a lap joint that is joined together by bolts 94 and corresponding nuts 96 that extend through holes formed in the joining ends of each L-shaped member 28. Knobs 98 and corresponding holes 100 are formed on the joining ends of the L-shaped members 28 to aid in alignment of the joining ends of the L-shaped members 28. It will be understood that, although a lap joint with bolts and nuts are shown to join the L-shaped members 28, other methods of joining the L-shaped members 28 to form the coupling joint 30 may be used.

Figure 7:
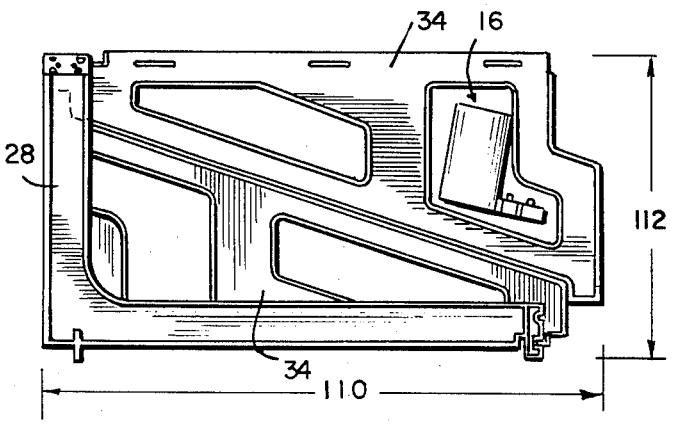
FIG. 7 is a top plan view illustrating the dimensional relationship of the major components disassembled and stacked.

FIG. 7 shows the dimensional characteristics of the frame assembly 12 in a disassembled state. Specifically, FIG. 7 shows a width dimension 112 approximately equal to the length of the bottom-most short portion of the L-shaped member 28 and a length dimension 110 approximately equal to the height of the outrigger member 34 in its assembled condition plus the height of one of its sides, i.e., webs and into which the frame assembly 12 can be disassembled and stacked. As seen in FIG. 7, the length of the lower portion of one of the L-shaped members 28 is substantially equal to the width 112. The width 112 also corresponds generally to the width of the base of each of the outrigger members 34. Thus, when the frame assembly 12 is broken down into its component parts, these parts can be stacked somewhat as illustrated in FIG. 7 to form a shipping package having dimensions not significantly greater than a width 112 and a length 110. This greatly simplifies the problems encountered in shipping and in storing the frame assembly 12 of the Present invention.

The present invention provides a swing assembly 10 that needs no overhead structure to support the child bearing seat. This permits unobstructed access to the child and to the seat. In addition, the frame assembly 12 is formed from component parts that are generally interchangeable with each other which greatly simplifies the assembly of the swing, as well as simplifying the construction of the swing by the manufacturer. The use of A-shaped support frames 24 attached to a center U-shaped base member 22 provides a stable platform for the swing. The configuration of the A-shaped support frames 24 and the U-shaped base member 22 permits easy assembly and disassembly of th frame assembly 12. In addition, the frame assembly 12, and specifically the A-shaped support frames 24, presents an attractive and attention-getting appearance to young children.

Although the invention has been described in detail with reference to a preferred embodiment and specific examples, variations and modifications exist within the scope and spirit of the invention as described and defined in the following claims.

What is claimed is:

1. A swing assembly comprising first and second swing support frames, each support frame including a pair of upstanding support members, base means for rigidly fixing the pair of upstanding support members in abutting relationship along at least a major portion of their length side-by-side one another in substantially perpendicular relation to an underlying surface, and coupling means for interconnecting the base means of the first and second swing support frames to align the pairs of upstanding support members in spaced-apart parallel relation to define a swing-receiving space therebetween, each pair of upstanding support members cooperating to provide a distal portion situated in vertically spaced-apart relation to the coupling means, a swing seat, and hanger means connected to the swing seat for suspending the swing seat in the swing-receiving space above the coupling means, the hanger means being pivotally connected to each of the distal portions of the spaced-apart pairs of upstanding support members so that the hanger means and the swing seat pivot about an axis extending between the pairs of upstanding support members during movement of the swing seat relative to the first and second swing support frames.

2. The swing assembly of claim 1, wherein the hanger means is configured to extend away from the swing seat in opposite directions toward the spaced-apart pairs of upstanding support members so that the hanger means is positioned intermediate the swing seat and each of the pair of upstanding support members without overlying the swing seat in spaced relation thereto.

3. The swing assembly of claim 1, wherein each upstanding support member includes an upper end and a lower end, each base means includes an outrigger base member attached to the lower end of each companion upstanding support member so that each swing support frame has a pair of oppositely extending outrigger base members which cooperate to stabilize the companion pair of upstanding support members in substantially perpendicular relation to the underlying surface during swinging movement of the swing seat.

4. The swing assembly of claim 1, wherein each base means includes an L-shaped member having a horizontal leg oriented in substantially orthogonal relation to its companion pair of upstanding support members, the horizontal leg includes a proximal end rigidly connected to one of the swing support frames and a distal end projected toward the other of the swing support frames, and the coupling means is configured to join the distal ends of the opposing horizontal legs securely together so that the first and second swing support frames are maintained in fixed relation one-to-another during swinging movement of th swing seat.

5. A swing assembly comprising first and second swing support frame, each support frame including a pair of upstanding support members, base mans for rigidly fixing the pair of upstanding support members side-by-side one another in substantially perpendicular relation to an underlying surface, and coupling means for interconnecting the base means of the first and second swing support frames to align the pairs of upstanding support members in spaced-apart parallel relation to define a swing-receiving space therebetween, each pair of upstanding support members cooperating to provide a distal portion situated in vertically spaced-apart relation to the coupling means, a swing seat, and hanger means connected to the swing seat for suspending the swing seat in the swing-receiving space above the coupling means, the hanger means being pivotably connected to each of the distal portions of the spaced-apart pairs of upstanding support members so that the hanger means and the swing seat pivot about an axis extending between the pairs of upstanding support members during movement of the swing seat relative to the first and second swing support frames, wherein each base means includes an L-shaped member having a vertical leg connected to both companion upstanding support members to align said pair of upstanding support members in side-by-side relation and locking means for rigidly retaining the vertical leg and its companion pair of upstanding support members in said aligned relation to aid in preventing relative movement of the members comprising each swing support frame during swinging movement of the swing seat, each pair of upstanding support members being configured to provide a lip-receiving trough in said distal portion, the vertical leg including a top lip sized to fit in the lip-receiving trough when the vertical leg is retained in said aligned relation so that the top lip lies between the side-by-side upstanding support members, the top lip being formed to include at least one upwardly opening tongue-receiving groove, the locking means further including a locking block having tongue means configured to engage the at least one tongue-receiving groove in the top lip and being formed to include first and second flange-receiving grooves, and each of said companion upstanding support members including a flange configured to engage only one of the first and second flange-receiving grooves in the locking block so that the top lip and the locking block cooperate to secure the vertical leg and its companion pair of upstanding support members in said aligned relation.

6. The swing assembly of claim 5, wherein the hanger means is pivotally connected to each locking block to suspend the swing seat therebetween.

7. A swing assembly comprising first and second swing support frames, each support frame including a pair of upstanding support members, base means for rigidly fixing the pair of upstanding support members side-by-side one another in substantially perpendicular relation to an underlying surface, and coupling means for interconnecting the base means of the first and second swing support frame to align the pairs of upstanding support members in spaced-apart parallel relation to define a swing-receiving space therebetween, each pair of upstanding support members cooperating to provide a distal portion situated in vertically spaced-apart relation to the coupling means, a swing seat, and hanger means connected to the swing seat for suspending the swing seat in the swing-receiving space above the coupling means, the hanger means being pivotably connected to each of the distal portions of the spaced-apart pairs of upstanding support members so that the hanger means and the swing seat pivot about an axis extending between the pairs of upstanding support members during movement of the swing seat relative to the first and second swing support frames, the hanger means including first and second hanger assemblies, each hanger assembly extending between the swing seat and a selected one of the first and second swing support frame without overlying the swing seat, each hanger assembly including a seat arm having a proximal end fixed to the swing seat and an opposite distal end, a support arm having a proximal end pivotally connected to the selected swing support frame and an opposite distal end, and quick-release means for detachably interconnecting the distal ends of each seat arm and its companion support arm to permit selective separation of the swing seat and the first and second swing support frames.

8. A swing assembly comprising first and second swing support frames, each support frame including a pair of upstanding support members, base means for rigidly fixing the pair of upstanding support members side-by-side one another in substantially perpendicular relation to an underlying surface, and coupling means for interconnecting the base means of the first and second swing support frames to align the pairs of upstanding support members in spaced-apart parallel relation to define a swing-receiving space therebetween, each pair of upstanding support members cooperating to provide a distal portion situated in vertically spaced-apart relation to the coupling means, a swing seat, and hanger means connected to the swing seat for suspending the swing seat in the swing-receiving space above the coupling means, the hanger means being pivotably connected to each of the distal portions of the spaced-apart pairs of upstanding support members so that the hanger means and the swing seat pivot about an axis extending between the pairs of upstanding support members during movement of the swing seat relative to the first and second swing support frame, wherein each base means includes an L-shaped member having a vertical leg connected to both companion upstanding support members to align said pair of upstanding support members in side-by-side relation and locking means for rigidly retaining the vertical leg and its companion pair of upstanding support members in said aligned relation to aid in preventing relative movement of the members comprising each swing support frame during swinging movement of the swing seat, the vertical leg including an outwardly extending mounting ledge positioned to support the companion pair of upstanding support members in a predetermined position above the underlying surface to align the vertical leg and the companion pair of upstanding support members in predetermined relative positions so that the locking means is easily coupled to the vertical leg and the companion pair of upstanding support members during assembly of the swing assembly.

9. A swing assembly comprising first and second swing support frames, each support frame including a pair of upstanding support members, base means for rigidly fixing the pair of upstanding support members side-by-side one another in substantially perpendicular relation to an underlying surface, and coupling means for interconnecting the base means of the first and second swing support frames to align the pairs of upstanding support members in spaced-apart parallel relation to define a swing-receiving space therebetween, each pair of upstanding support members cooperating to provide a distal portion situated in vertically spaced-apart relation to the coupling means, a swing seat, and hanger means connected to the swing seat for suspending the swing seat in the swing-receiving space above the coupling means, the hanger means being pivotally connected to each of the distal portions of the spaced-apart pairs of upstanding support members so that the hanger means and the swing seat pivot about an axis extending between the pairs of upstanding support members during movement of the swing seat relative to the first and second swing support frames, wherein each base means includes an L-shaped member having a vertical leg connected to both companion upstanding support members to align said pair of upstanding support members in side-by-side relation and locking means for rigidly retaining the vertical leg and its companion pair of upstanding support members in said aligned relation to aid in preventing relative movement of the members comprising each swing support frame during swinging movement of the swing seat, the vertical leg including a top portion situated adjacent to said distal portion provided by the companion pair of upstanding support members, the top portion being formed to include a flange-receiving slot opening toward the companion pair of upstanding support members, and each adjacent upstanding support member including a flange for engaging a selected portion of the flange-receiving slot to align the vertical leg and the companion pair of upstanding support members in predetermined relative positions so that the locking means is easily coupled to the vertical leg and the companion pair of upstanding support members during assembly of the swing assembly.

10. A swing assembly comprising first and second swing support frames, each support frame including a pair of upstanding support members, base means for rigidly fixing the pair of upstanding support members side-by-side one another in substantially perpendicular relation to an underlying surface, and coupling means for interconnecting the base means of the first and second swing support frames to align the pairs of upstanding support members in spaced-apart parallel relation to define a swing-receiving space therebetween, each pair of upstanding support members cooperating to provide a distal portion situated in vertically spaced-apart relation to the coupling means, a swing seat, and hanger means connected to the swing seat for suspending the swing seat in the swing-receiving space above the coupling means, the hanger means being pivotably connected to each of the distal portions of the spaced-apart pairs of upstanding support members so that the hanger means and the swing seat pivot about an axis extending between the pairs of upstanding support members during movement of the swing seat relative to the first and second swing support frames, wherein each base means includes an L-shaped member having a vertical leg connected to both companion upstanding support members to align said pair of upstanding support members in side-by-side relation and locking means for rigidly retaining the vertical leg and its companion pair of upstanding support members in said aligned relation to aid in preventing relative movement of the members comprising each swing support frame during swinging movement of the swing seat, the vertical leg being formed to include a plurality of apertures, each upstanding support member being formed to include a plurality of apertures, and the locking means including a locking strip having a plurality of connectors configured to pass through the apertures formed in the pair of upstanding support members and in the vertical leg and lockably engage the vertical leg so that the pair of upstanding support members is trapped in a selected position between the inner vertical leg and the relatively outer locking strip.

11. A swing assembly comprising a U-shaped frame including first and second vertical side legs and a horizontal bottom leg extending therebetween, first and second swing support frames, first locking means for rigidly connecting the first swing support frame to the first vertical side leg, second locking means for rigidly connecting the second swing support frame to the second vertical side leg, the first and second locking means cooperating to align the first and second swing support frames in substantially spaced-apart parallel relation, a swing seat having opposite side portions, first hanger means interconnecting the first vertical side leg an the swing seat for pivotally supporting one side portion of the swing seat, and second hanger means interconnecting the second vertical side leg and the swing seat for pivotally supporting the other side portion of the swing seat, the first and second hanger means cooperating to suspend the swing seat for pivotable movement between the first and second vertical side legs about an axis extending between the first and second vertical side legs without overlying the swing seat during swinging movement of the swing seat, each hanger means including a seat arm having a proximal end fixed to the swing seat and an opposite distal end, a support arm having a proximal end pivotally connected to the s®1®cted swing support frame and an opposite distal end, and quick-release means for detachably interconnecting the distal ends of each seat arm and its companion support arm to permit selective separation of the swing seat and the first and second swing support frames.

12. A swing assembly comprising a U-shaped frame including first and second vertical side legs and a horizontal bottom leg extending therebetween, first and second swing support frames, first locking means for rigidly connecting the first swing support frame to the first vertical side leg, second locking means for rigidly connecting the second swing support frame to the second vertical side leg, the first and second locking means cooperating to align the first and second swing support frames in substantially spaced-apart parallel relation, a swing seat having opposite side portions, first hanger means interconnecting the first vertical side leg and the swing seat for pivotally supporting one side portion of the swing seat, and second hanger means interconnecting the second vertical side leg and the swing seat for pivotally supporting the other side portion of the swing seat, the first and second hanger means cooperating to suspend the swing seat for pivotable movement between the first and second vertical side legs about an axis extending between the first and second vertical side legs without overlying the swing seat during swinging movement of the swing seat, the horizontal bottom leg including a first bottom leg segment having a proximal end connected to the first vertical side leg and a distal end, a second bottom leg segment having a proximal end connected to the second vertical side leg and a distal end, and coupling means for detachably interconnecting the opposing distal ends of the first and second bottom legs segments.

13. A swing assembly comprising first and second swing support frame, each support frame including a pair of upstanding support members, base means for rigidly fixing the pair of upstanding support members abutting side-by-side one another in substantially perpendicular relation to an underlying surface, the base means having a separate connector to each member where they abut, and coupling means for interconnecting the base means of the first and second swing support frames to align the pairs of upstanding support members in spaced-apart parallel relation to define a swing-receiving space therebetween, each pair of upstanding support members cooperating to provide a distal portion situated in vertically spaced-apart relation to the coupling means, a swing seat, and hanger means connected to the swing seat for suspending the swing seat in the swing-receiving space above the coupling means, the hanger meals being pivotably connected to each of the distal portions of the spaced-apart pairs of upstanding support members so that the hanger means and the swing seat pivot about an axis extending between the pairs of upstanding support members during movement of the swing seat relative to the first and second swing support frames.

* * * * *

UNITED STATES PATENT AND TRADEMARK OFFICE

CERTIFICATE OF CORRECTION

PATENT NO. : 4,807,872

DATED : February 28, 1989

INVENTOR(S) : Raymond Spilman et al.

It is certified that error appears in the above-identified patent and that said Letters Patent is hereby corrected as shown below:

At column 1, line 54, please delete "s-same", and insert therefor --same--;

At column 1, line 68, after "support" (first occurrence), please insert --frames to--;

At column 3, line 27, please delete "Perceived" and insert therefor --perceived--;

At column 3, line 57, please delete "AND" and insert therefor --and--;

At column 4, line 21, after "12", please insert --.-- (period);

At column 8, line 11, please delete "Present" and insert therefor --present--;

At column 8, line 24, please delete "th" and insert therefor --the--;

At column 9, line 22, please delete "th" and insert therefor --the--;

At column 9, line 24, please delete "frame" and insert therefor --frames--;

At column 9, line 26, please delete "mans" and insert therefor --means--;

At column 10, line 20, please delete "frame" and insert therefor --frames--;

UNITED STATES PATENT AND TRADEMARK OFFICE

CERTIFICATE OF CORRECTION

PATENT NO. : 4,807,872

DATED : February 28, 1989

INVENTOR(S) : Raymond Spilman et al.

It is certified that error appears in the above-identified patent and that said Letters Patent is hereby corrected as shown below:

At column 10, line 40, please delete "frame" and insert therefor --frames--;

At column 11, line 6, please delete "frame" and insert therefor --frames--;

At column 13, line 11, please delete "s®l®cted" and insert therefor --selected--;

At column 14, line 11, please delete "legs" and insert therefor --leg--; and

At column 14, line 13, please delete "frame" and insert therefor --frames--.

Signed and Sealed this

Twenty-ninth Day of August, 1989

*Attest:*

*Attesting Officer*

DONALD J. QUIGG

*Commissioner of Patents and Trademarks*